United States Patent [19]

Weiss

[11] Patent Number: 4,834,377

[45] Date of Patent: May 30, 1989

[54] TENNIS BALL CONTAINMENT APPARATUS

[76] Inventor: Craig R. Weiss, 6611 N. Central Ave., Phoenix, Ariz. 85012

[21] Appl. No.: 124,250

[22] Filed: Nov. 23, 1987

[51] Int. Cl.[4] ..... A63B 69/40

[52] U.S. Cl. ..... 273/29 A

[58] Field of Search ..... 273/26 A, 29 A

[56] References Cited

U.S. PATENT DOCUMENTS

| | | | |
|---|---|---|---|
| 2,644,334 | 7/1953 | Perry | 273/55 R |
| 2,829,901 | 1/1958 | Mateja | 273/25 |
| 3,399,891 | 9/1968 | McCormick et al. | 273/55 R |
| 3,684,283 | 8/1972 | Forrest | 273/55 R |
| 4,192,503 | 3/1980 | Karas | 273/29 A |

*Primary Examiner*—Edward M. Coven
*Assistant Examiner*—T. Brown
*Attorney, Agent, or Firm*—Harry M. Weiss

[57] ABSTRACT

The disclosure is directed to an apparatus and method for containing tennis balls that are struck by a tennis racquet either in the practice of tennis serves or in returning balls projected by a tennis ball machine. Key features include the use of a substantially "C" shaped containment means on one side of a tennis net to thereby capture tennis balls hit over the tennis net into a reduced containment area. The containment means is preferably higher than the tennis net and can be varied in size, as desired.

11 Claims, 1 Drawing Sheet

TENNIS BALL CONTAINMENT APPARATUS

BACKGROUND OF THE INVENTION

1. Field of Invention

The present invention generally relates to an apparatus and method for containing tennis balls and, more particularly, relates to an apparatus and method for containing tennis balls that are struck by a tennis racquet after either hitting practice serves or returning tennis balls projected by a tennis ball machine.

2. Description of the Prior Art

In the past, a person practicing tennis serves or using a tennis ball machine would usually hit tennis balls all over the tennis court and the struck tennis balls would then end up on the ground spread all over the court and the exterior portions thereof in random spaced apart locations.

This caused a number of problems relating to cost and lost of time. One such problem is that at most private or public tennis facilities tennis court use and/or tennis ball machines are generally rented out based on time usage which includes the lost time spent gathering and picking up the hit tennis balls. This invention will save a tennis player time which will result in money savings because the player will be able to reduce the time spent in gathering up the tennis balls thereby providing more playing time within any given time period.

This time savings will also be applicable or available to a tennis player who rents out, for a period of time, a basket of tennis balls to practice serving, ground strokes, volleys, etc. With this invention, the player can reduce the gathering and pick-up time of the struck tennis balls providing more playing time within any given time period.

Generally, after someone finishes practicing serving or hitting a basket of tennis balls, they usually still have to spend up to 20 minutes or more gathering and picking up the tennis balls strewn all over the ground. This invention reduces the tennis ball gathering and pick up time, thus permitting more time to be spent in the fun part of using the tennis balls to practice serving or to hit them off the ball machine.

Yet another problem that this invention addresses is to reduce the rather substantial costs of purchasing or replacing tennis balls that are used for practicing serves or for ball machines because of wear out since tennis balls like most other balls of various sports slowly but surely wear out and become too light or go "bad" after substantial use. In tennis practice, the relatively fast moving, struck, tennis balls generally first strike the ground and then bounce around hitting containment fences which are usually made of fairly abrasive chain link type fencing material and these tennis balls continue bouncing along the ground for a substantial period of time until finally coming to a stop. With this invention, the struck tennis balls do not hit abrasive containment fences nor do the balls hit the ground as often. As a result, the speed of these struck tennis balls is significantly reduced to accomplish the goals of shortening the time these balls are in motion, reducing the balls bouncing around time, and, consequently substantially reducing the wear and tear on these tennis balls. This invention can thus permit or allow each practice tennis ball's life to be significantly increased.

SUMMARY OF THE INVENTION

It is an object of this invention to provide an apparatus and method for containing tennis balls that are struck by a racquet during practice so that the user will be able to spend less time gathering and picking up the tennis balls from the ground and more time actually practicing.

It is a further object of this invention to provide an apparatus and method for containing tennis balls that are struck by a racquet during practice, which allows a practicing tennis player to either serve tennis balls or to hit tennis balls off of a tennis ball machine to the other side of the tennis court into a containment means, which would not allow the tennis balls to randomly fly and/or bounce around all over the court.

It is still a further object of this invention to provide an apparatus and method for containing tennis balls that are struck, during practice, by a tennis racquet to save on the gathering and pick up time by significantly reducing the area that the struck balls will be located to permit all of the tennis balls to be in the same contained, reduced area so that they can be gathered and picked up quicker.

It is yet another object of this invention to provide an apparatus and method for containing tennis balls that are struck by a racquet during practice in order to save money by reducing gathering and pick up time and the wear and tear on the balls while permitting more time for practicing.

These and other features of the present invention will be understood upon reading of the following description along with the drawings.

DESCRIPTION OF THE PREFERRED EMBODIMENT

Figure 1:
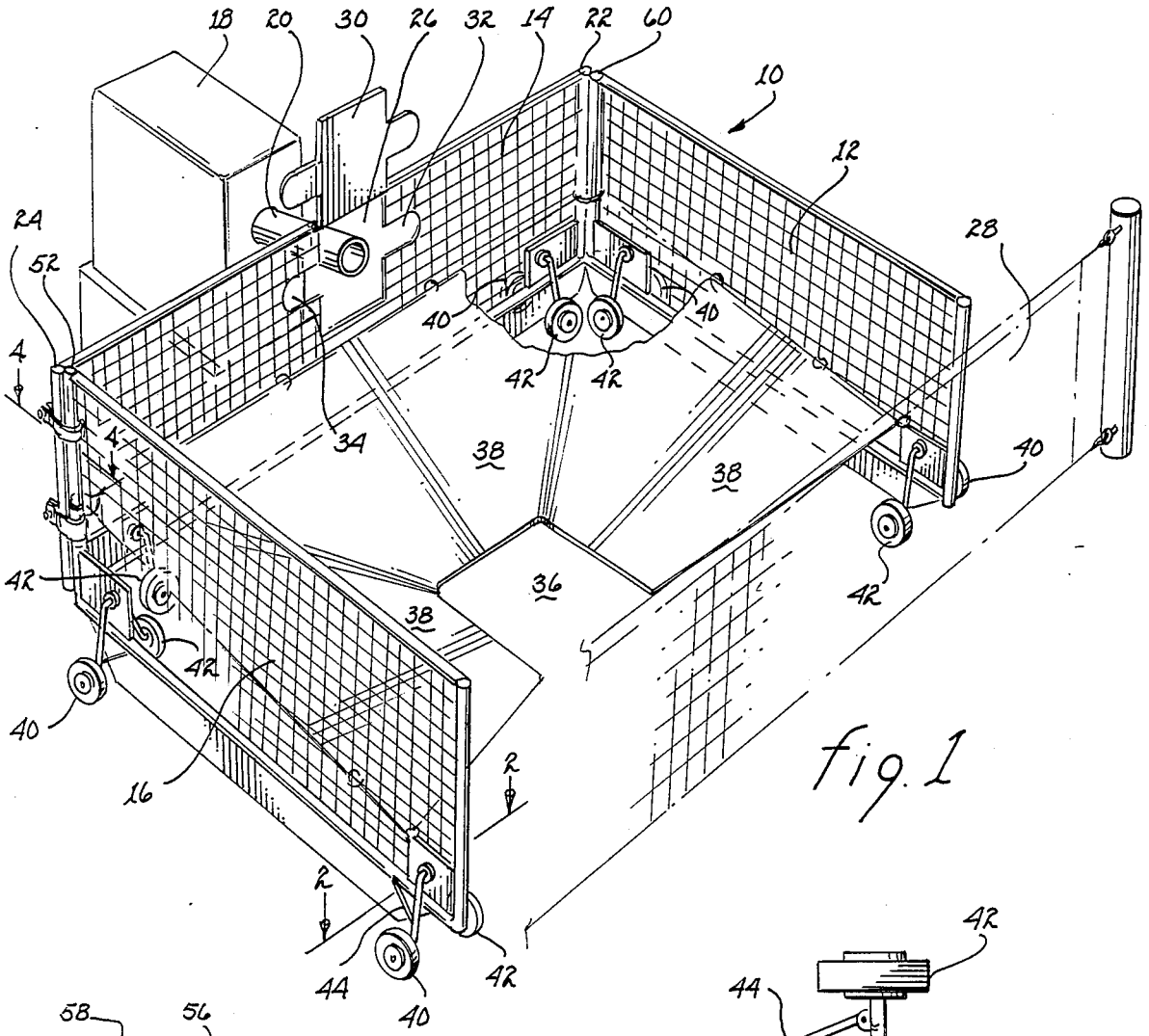
FIG. 1 is a perspective view of the apparatus for containing practice tennis balls in accordance with this invention.

Referring now to FIG. 1 of the accompanying drawings, reference numeral 10 generally depicts an apparatus in accordance with this invention for containing tennis balls that are struck by a tennis racquet during practice. The apparatus 10 preferably comprises three net portions or units 12, 14 and 16 which can be either separate, individual units as shown in FIG. 1 or connected together as one single unit having a center portion and two end portions. A tennis ball machine 18 having an elongated tube 20 for projecting tennis balls is preferably located, when in use, in a position intermediate end posts 22 and 24 of the center unit 14 in order to propel tennis balls (not shown), that are loaded into the tennis ball machine 18, through an opening 26 that is located in the center unit 14 and over tennis net 28 (shown in phantom) to be returned by a person practicing hitting ground strokes or volleys located on the other side of the tennis net 28 from the apparatus 10 and the tennis ball machine 18.

If desired, the tennis ball machine 18 can be removed and the opening 26 can be closed by means of flap 30, which is configured to conform to the geometry of the opening 26, to permit the apparatus 10 to be used to contain, for example, tennis balls struck by a person located on the opposite side of the tennis net 28 who is practicing hitting tennis serves. The opening 26 has outwardly extending slotted portions 32 and 34 that permit an oscillating prallel sweep of the elongated tube 20 of the tennis ball machine 18 when the tennis ball machine 18 is used to propel tennis ball from side to side over the tennis net 28.

The dimensions of the apparatus 10, which preferable has a height of several feet e.g. five feet, can be varied or selected, as desired, to either provide a relatively larger containment area for capturing tennis balls or a relatively smaller containment area for capturing tennis balls. For example, a relatively small tennis ball containment area 36 can be provided by locating the side unit 12 on or adjacent to one side line of the "singles" portion of a tennis court, the side unit 16 on or adjacent to the other side line of the "singles" portion of the tennis court, and the intermediate or center unit 14 on or adjacent to the line that ends the service boxes which is inside of the end base line and parallel to both the end base line and the tennis net 28. All tennis court dimensions expressed in the application are obviously based on the approved tennis court dimensions of the United States Tennis Association (U.S.T.A.). This small containment area 36 provided by locating the units 12, 14 and 16 as described above can be used to contain the tennis balls that are either struck and returned back over the tennis net 28 after being propelled over the tennis net 28 by the tennis ball machine 18 or struck by a person practicing tennis services on the opposite side of the tennis net 28 from the location of the apparatus 10.

If desired, a larger tennis ball containment area 36 can be provided by using longer side units 12 and 16. For example, if someone wanted to practice hitting tennis balls over the full scope of the entire "singles" portion of the tennis court (which is the "singles" half portion of the tennis court located on the same side of the tennis court that contains the apparatus 10), the side units 12 and 16 would be long enough to extend from about the vicinity of the tennis net 28 to or adjacent to the base line of the tennis court. The intermediate or center unit 14 would be placed at or adjacent to the base line of the tennis court, but would still extend to contact the side units 12 and 16 without the need to provide a longer center unit 14.

A still larger tennis ball containment area can be provided if one desired to hit tennis balls over the full scope of the entire "doubles" porton of the tennis court which is now the enlarged half portion of the tennis court bounded by the two tennis court "doubles" side lines and the back base line. The apparatus 10 now bounds the exterior side lines of the "alleys" of the "doubles" portion of the tennis court that are the two elongated rectangular regions that are to the left and to the right of the centrally disposed "singles" tennis court portion and the longer back base line portion that extends to the two exterior "doubles" side lines. In this example, the apparatus 10 will have a longer intermediate or center unit 14 to meet the two side units 12 and 16 which will be of the same general length as the extended side units 12 and 16 that are used to provide the full scope of the "singles" tennis court portion.

Referring again to FIG. 1, if desired, an inwardly extending, downwardly slanted net extension portion 38 is provided as an extension of each of the units 12, 14 and 16. As can be seen with reference to FIG. 1, the net extension portion 38 extends downwardly from the inner, bottom portions of each of the units 12, 14 and 16 to touch the surface of the tennis court and thereby define an even smaller tennis ball containment area that is located centrally and inwardly from the units 12, 14 and 16. The net extension portion 38 can be made and attached to the three units 12, 14 and 16 as either a single "C" shaped piece or three individual pieces that are each separately attached to one of the three units 12, 14 and 16. These three net extension portions 38 can, if desired be overlapped. Preferably the net extension portions 38 are slack enough to achieve the goal of gradually directing the tennis balls to the containment area 36 while preventing tennis balls first hitting the net extension portions 38 from bouncing over the wall portions 12, 14 and 16.

Figure 2:
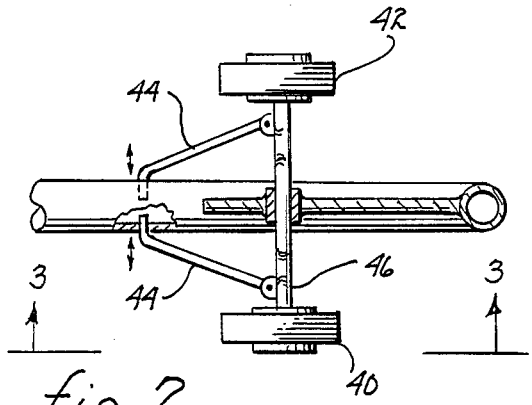
FIG. 2 is a view taken along the line 2—2 of FIG. 1 depicting one of the series of preferably dual wheels used to vertically support each of the sections of the containing apparatus of FIG. 1.

Referring to FIGS. 1 and 2, preferably, a pair of wheels 40, 42 are provided at the two ends of each of the units 12, 14 and 16. Thus, twelve wheels are provided as part of the apparatus 10 (four for each of the units 12, 14 and 16). The six interior wheels 42 cooperate with the six exterior wheels 40 (only five are shown in FIG. 1) to provide separate, mobile support for each of the units 12, 14 and 16 to thereby permit the apparatus 10 to be rapidly wheeled on or off the tennis court, as desired.

Figure 3:
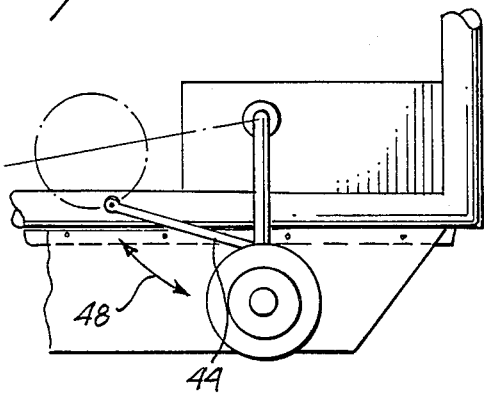
FIG. 3 is a view taken along the line 3—3 of FIG. 2 depicting a mechanical arrangement for raising each pair of wheels when the sections of the containing apparatus are in position for use or in a storage location and for lowering each pair of wheels to contact the ground when mobility is desired.

As can be seen with reference to FIGS. 1, 2 and 3, a pair of arms 44 are connected to a substantially "U" shaped axle 46 of the pair of wheels 40, 42 and serve to permit the raising or lowering the wheels 40, 42 (as shown by arrows 48 of FIG. 3), as desired. The upper ends of the arms 44 are removably attached to the bottom post of each of the units by means of a pair of openings in the bottom post that can hold the inwardly biased upper ends of the arms 44. Thus, when the upper ends of the arms 44 are in the holes of the bottom post, the wheels 40, 42 are below the bottom post ready to wheel the apparatus 10 to any desired position. However, when the upper ends of the arms 44 are removed from the holes in the bottom post, the wheels 40, 42 can be pivoted upwardly (to the phantom position shown above the bottom post) thereby permitting the unit to rest on the bottom post (and not on the wheels) when mobility is not needed. In the raised position, the wheels 40, 42 will be off the tennis court for use of the apparatus 10 on the tennis court or in a storage area whereas, in the lowered position, the wheels 40, 42 will be in a better position for rapidly moving the apparatus 10.

Figure 4:
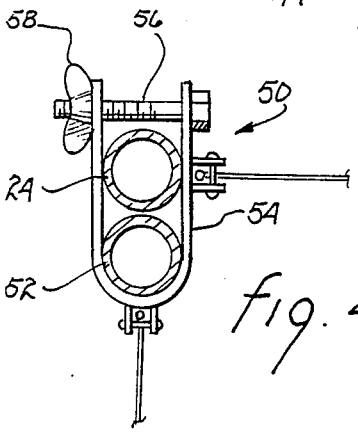
FIG. 4 is a view taken along the line 4—4 of FIG. 1 depicting the clamp arrangement for holding together the two adjacent end poles provided by two separate sections of the containing apparatus of FIG. 1.

Referring to FIG. 1 and FIG. 4, a clamp assembly generally designated by reference number 50 is used for holding together end post 24 of the center unit 14 and end post 52 of the side unit 16. The clamp assembly 50 comprises a "U" shaped member 54 which is bolted into a clamping position by means of using bolt 56 and nut 58 as shown in FIG. 4. The clamping position of the clamp assembly 50 shown in FIG. 4 serves to hold together side unit 16 to center unit 16. Similarly, end post 60 of the side unit 12 is held or clamped together with the end post 22 of the center unit 14 by means of similar clamp assemblies 50 (not shown). Preferably, two clamp assemblies 50 are used at each end of the center unit 14 for better clamping or holding action (see the left side portion of FIG. 1).

Figure 5:
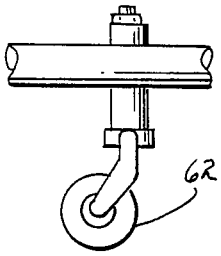
FIG. 5 is a side elevational view depicting the use of a caster rather than a wheel for easier multi-directional movement.

Referring to FIG. 5, a free wheeling, multi-directional caster 62 is used, if desired, as a substitute for each of the wheels 40, 42 of of FIG. 1. In this manner, more flexibility in the direction of movement of each of the units 12, 14 and 16 can be achieved because the casters 62 can permit each of the units 12, 14 and 16 to be rapidly moved in virtually any desired direction along the surface of the tennis court.

OPERATION

Accordingly, a person desiring to use the apparatus 10 to contain tennis balls during tennis practice while practicing tennis serves or the hitting of tennis balls off of a tennis ball machine need merely to roll or wheel the units 12, 14 and 16 of the apparatus 10 onto one side of the tennis net 28. The tennis practicing person then goes to the other side of the tennis net 28 and proceeds, if practicing serves, to hit tennis balls over the net from either serving portion (into either the "deuce" or "ad" service boxes on the opposite side of the tennis net 28). Both the "deuce" and "ad" (left and right) service boxes are circumscribed or contained by the apparatus 10. Thus, service balls coming over the tennis net 28 will generally hit within the selected service box "deuce" or "ad" box and immediately bounce up and hit one or more of the units 12, 14 and 16 depending on the angle of the served tennis ball, the velocity of the tennis ball, and the distance of tennis ball travel from the location of the server. Because of the soft preferably net type surface provided by the three net walls of the units 12, 14 and 16, the velocity and bounceability of the tennis balls hitting one or more of the three walls will be significantly reduced within the four "walls" provided by (a) the three walled apparatus 10 and (b) the fourth wall provided by the tennis net 28. The tennis net extension portion 38, because of its downward and inwardly sloped configuration, serves to direct all tennis balls bouncing within the containment area 36 to an even more reduced containment area portion to facilitate and expedite gathering and pick up of the tennis balls within the containment area 36.

Similarly, in the use of the tennis ball machine 18, as shown in FIG. 1, the flap 30 is raised from a closed position (which is the position of the tennis flap 30 when practicing tennis serves) to the position shown in FIG. 1. Then, the tennis ball machine 18 is manuevered into the position shown in FIG. 1 to permit a person to practice tennis ground strokes and/or volleys from the opposite side of the tennis net 28 than where the tennis ball machine 18 is located. Thus, tennis balls hit by the practicing tennis player will be hit back over the tennis net 28 and usually land in the containment area 36. Because of the apparatus 10, the tennis balls that are hit from the tennis ball machine 18 have a significantly reduced velocity and bounceability action after the struck tennis balls land within the apparatus 10 as described above with respect to the description of the use of the apparatus 10 for the practice of serves.

While the invention has been particularly shown and described in reference to preferred embodiments thereof, it will be understood by those skilled in the art that changes in form and details may be made without departing from the spirit and scope of the invention.

I claim:

1. A tennis ball containment apparatus comprised of a first side wall portion, a second side wall portion and an intermediate wall portion coupled to said first and second side wall portions and defining a substantially "C" shaped configuration, said first side wall portion being separated from said second side wall portion by at least the width of a "singles" tennis court of a standard United States Tennis Association tennis court size; a tennis net located adjacent to said first and second side wall portions, each of said wall portions having a height higher than the height of said tennis net, each of said side wall portions having a length substantially equal to the length of one of the side lines of a tennis court that extends from the end base line on one side of the tennis court to the center tennis net.

2. The apparatus of claim 1 wherein said intermediate wall portion having a length at least approximately equal to the distance of the line that terminates the service boxes of either side of a tennis court.

3. The apparatus of claim 1 wherein each of said wall portions having a net type vertical wall portion.

4. The apparatus of claim 3 wherein rotating means are attached to each of said wall portions for permitting rapid mobility of each of said wall portions.

5. The apparatus of claim 4 wherein said rotating means comprise a plurality of pairs of wheels, each of said pairs of wheels of each of said plurality of pairs of wheels having one wheel located on one side of said wall portions and the other wheel of said pair of wheels located on the other side of said wall portions.

6. The apparatus of claim 5, wherein means are provided for raising and lowering each of said pair of wheels.

7. The apparatus of claim 4 wherein said rotating means comprise a plurality of pairs of casters, each of said pair of casters of each of said plurality of pairs of casters having one caster located on one side of said wall portions and the other caster of said pair of casters located on the other side of said wall portions, each of said casters having movement in any given direction.

8. The apparatus of claim 1 wherein each of said wall portions being separate and holding means are provided for holding together said separate wall portions in said "C" shaped configuration.

9. The apparatus of claim 1 wherein said intermediate wall portion extending between said side wall portions substantially along the end base line of a tennis court.

10. The apparatus of claim 9 wherein said intermediate wall portion having a length substantially equal to the length of the end base line for one side of a "singles" tennis court.

11. The apparatus of claim 9 wherein said intermediate wall portion having a length substantially equal to the length of the end base line for one side of a "doubles" tennis court, said side portions being located substantially along the side lines of one side of a "doubles" tennis court.

* * * * *